US006031921A

United States Patent [19]

Mizoguchi

[11] Patent Number: 6,031,921

[45] Date of Patent: Feb. 29, 2000

[54] LOUDSPEAKER UNIT

[75] Inventor: Akio Mizoguchi, Kanagawa, Japan

[73] Assignee: Aiwa Co., Ltd., Tokyo, Japan

[21] Appl. No.: 09/039,743

[22] Filed: Mar. 16, 1998

[30] Foreign Application Priority Data

Mar. 25, 1997 [JP] Japan ..... P9-072158

[51] Int. Cl.[7] ..... H04R 25/00

[52] U.S. Cl. ..... 381/182; 381/89; 381/186

[58] Field of Search ..... 381/89, 335, 97, 381/182, 186, 332, 386, 387, 300, 301, 304, 307, 309; 181/144, 147, 199

[56] References Cited

U.S. PATENT DOCUMENTS 1,932,343 10/1933 Holland ..... 381/335

5,243,656 9/1993 Tanida et al. ..... 381/89

*Primary Examiner*—Huyen Le

*Attorney, Agent, or Firm*—Smith-Hill and Bedell

[57] ABSTRACT

A loudspeaker unit comprises a loudspeaker box, a first loudspeaker attached to a front panel of the loudspeaker box, and a second loudspeaker having the same diameter as that of the first loudspeaker and attached to an upper panel of the loudspeaker box. The first loudspeaker is driven in a positive polarity and the second loudspeaker is driven in a negative polarity. Driving voltages E1 and −E2 respectively for driving the first and the second loudspeaker are optional voltages meeting E2/E1<1. The sound pressure of sounds radiated by the second loudspeaker is lower than that of sounds radiated by the first loudspeaker. The directivity factor of the synthesis sound pressure of the first and the second loudspeaker at a sound receiving position with respect to the 90°-direction is equal to the product of the directivity factor D(90°) of the loudspeaker and a value (1−α) smaller than one. Accordingly, the output sound pressure of the loudspeaker can be reduced regardless of frequency.

6 Claims, 11 Drawing Sheets

FIG. 13 *Prior Art*
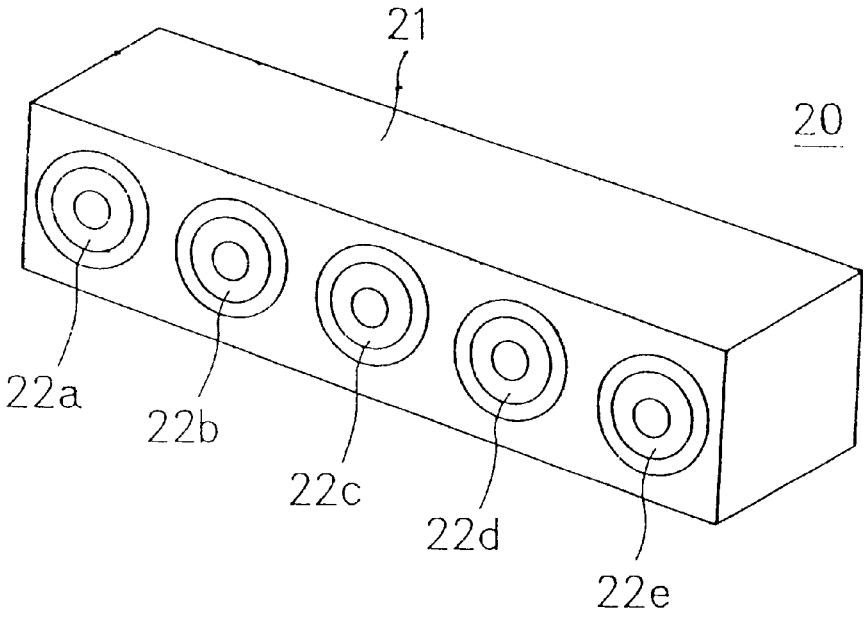
FIG. 14 *Prior Art*
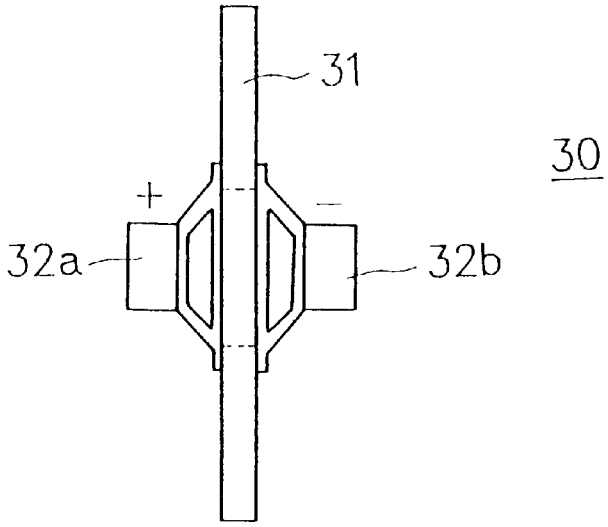

LOUDSPEAKER UNIT

BACKGROUND OF THE INVENTION

1. Field of the Invention

The present invention relates to a directional loudspeaker unit. More specifically, the present invention relates to a loudspeaker unit intended to realize directivity suitable for enlarging a region of satisfactory stereophonic listening position by attaching a first loudspeaker driven in a positive polarity to a front panel of a loudspeaker box, attaching a second loudspeaker driven in a negative polarity to, for example, an upper panel of the loudspeaker box, and driving the first and the second loudspeaker so that the radiation sound pressure of the second loudspeaker is lower than that of the first loudspeaker.

2. Description of the Related Art

The following are directional loudspeakers according to the prior art.

FIG. 13 shows a Tonsaulen directional loudspeaker unit 20 by way of example. The loudspeaker unit 20 has a plurality of loudspeakers, i.e., five loudspeakers 22*a* to 22*e*, linearly arranged on a panel of a loudspeaker box 21. The loudspeaker unit 20 provided with the laterally arranged plurality of loudspeakers has a sharp directivity in a horizontal plane.

FIG. 14 shows a bidirectional loudspeaker unit 30. This loudspeaker unit 30 is assembled by attaching two loudspeakers 32*a* and 32*b* to the front and the back surface of a baffle plate 31 opposite to each other. The two loudspeakers 32*a* and 32*b* are driven respectively in opposite polarities.

A loudspeaker unit according to the present invention, which will be explained later, is different in construction and directivity from the foregoing conventional directional loudspeaker units.

As shown in FIG. 15, a conventional two-channel stereophonic loudspeaker unit 40 has a right loudspeaker 41R attached to a front panel of a loudspeaker box 42R, and a left loudspeaker 41L attached to a front panel of a loudspeaker box 42L. The loudspeaker boxes 42R and 42L are disposed with their front panels facing a listener situated in front of the loudspeaker unit 40. When listening to stereophonic sounds generated by the loudspeaker unit 40, listening positions suitable for satisfactorily listening to stereophonic sounds are limited to those in a very narrow region including a point a on a center line bisecting a line connecting the loudspeakers 41R and 41L as indicated by a shaded region in FIG. 15.

Distances from a listening point b not on the center line to the right and the left loudspeakers are different from each other, sounds generated by the right loudspeaker 41R can be heard louder than those generated by the left loudspeaker 41L. Therefore, at the listening point b, sound image localization is biased toward the right loudspeaker 41R and hence a natural sound stage for two-channel stereophonic sounds cannot be created.

A conventional two-channel stereophonic sound reproducing method intended to enlarge a range for listening positions where satisfactory stereophonic listening is possible utilizes the directivity of loudspeakers.

A two-channel stereophonic loudspeaker unit 50 shown in FIG. 16 is provided with a right loudspeaker 51R and a left loudspeaker 51L attached to closed cabinets 52R and 52L with their reference axes directed inward at an angle of about 45° with respect to a center listening position to use directivity dependent on the diameters of the loudspeakers, and the dimensions and shapes of the cabinets.

This loudspeaker unit is intended to enlarge a region for listening positions where stereophonic sounds can be satisfactorily heard by the corrective agency of the directivities of the loudspeakers to reduce the difference between the respective levels of an R signal sound and an L signal sound attributable to the difference between distances from a listening position b dislocated from the center line to the loudspeakers.

Generally, directivity of a loudspeaker is dependent on the diameter of the loudspeaker, and the shape and dimensions of the cabinet, and a loudspeaker of a smaller diameter becomes directional for sounds of higher frequencies and becomes substantially non-directional for sounds of middle and low frequencies. Directivity for sounds of frequencies not higher than 1 KHz affects greatly appropriate listening region enlarging effect. In FIG. 16, a curve w1 indicates a directivity pattern for sounds of middle and high frequencies, a curve w2 indicates a directivity pattern for sounds of middle and low frequencies, and a indicates, similarly to a in FIG. 15, a point on the center line bisecting a line connecting the right and the left loudspeaker.

Directivity capable of enlarging a region for listening points must decrease sound pressure with the increase of the angle of a direction to the reference axis of the loudspeaker from 0° toward 90° as indicated by a curve w3 in FIG. 17, and it is desirable that the sound pressure with respect to a 90°-direction is lower than that with respect to a 0°-direction by 6 dB or above.

Accordingly, it is an object of the present invention to obtain directivity which makes the sound pressure of sounds of frequencies not higher than, for example, 1 KHz in the 90°-direction lower than that in the 0°-direction (axial direction) by 6 dB or above, i.e., directivity suitable for enlarging a region for satisfactory stereophonic listening positions.

SUMMARY OF THE INVENTION

A loudspeaker unit according to the present invention characterized in that a first loudspeaker is attached to a front panel of the loudspeaker box as installed, a second loudspeaker is attached to an upper panel, a lower panel or a back panel of the loudspeaker box as installed, the first loudspeaker is driven in a positive polarity and the second speaker is driven in a negative polarity, and the radiation sound pressure of the second loudspeaker is lower than that of the first loudspeaker.

The directivity factor in terms of the synthesis sound pressure of the first and the second loudspeaker at a sound receiving position in the 90°-direction is equal to the product of the directivity factor D(90°) of each loudspeaker and $(1-\alpha)<1$. That is, in the 90°-direction, the output sound pressure of the loudspeaker can be reduced regardless of frequency. The output sound pressure reduction ratio increases from 0° toward 90°, reaches a maximum of $(1-\alpha)$ at 90°, and decreases from 90° toward 180°.

BRIEF DESCRIPTION OF THE DRAWINGS

FIG. 13 is a perspective view of a conventional directional loudspeaker unit (Tonsäulen directional loudspeaker unit);

FIG. 14 is side view of a conventional directional loudspeaker unit (bidirectional loudspeaker);

DETAILED DESCRIPTION OF THE PREFERRED EMBODIMENT

Figure 1:
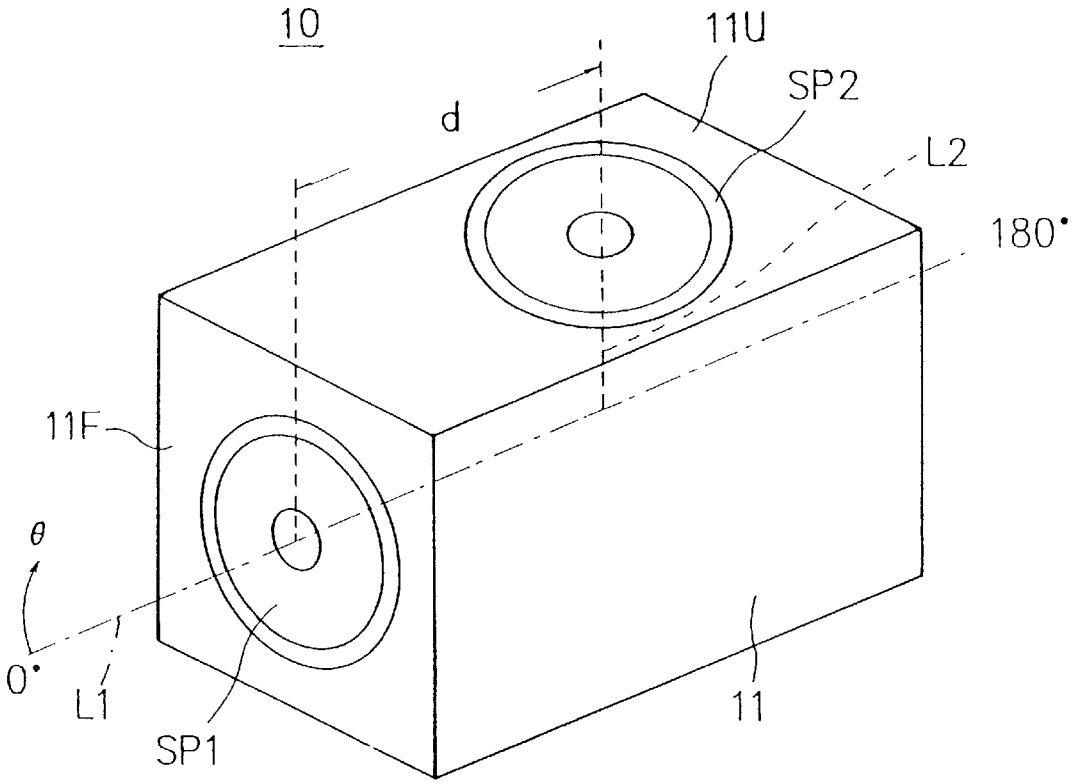
FIG. 1 is a perspective view of a loudspeaker unit in a preferred embodiment according to the present invention.
Figure 2:
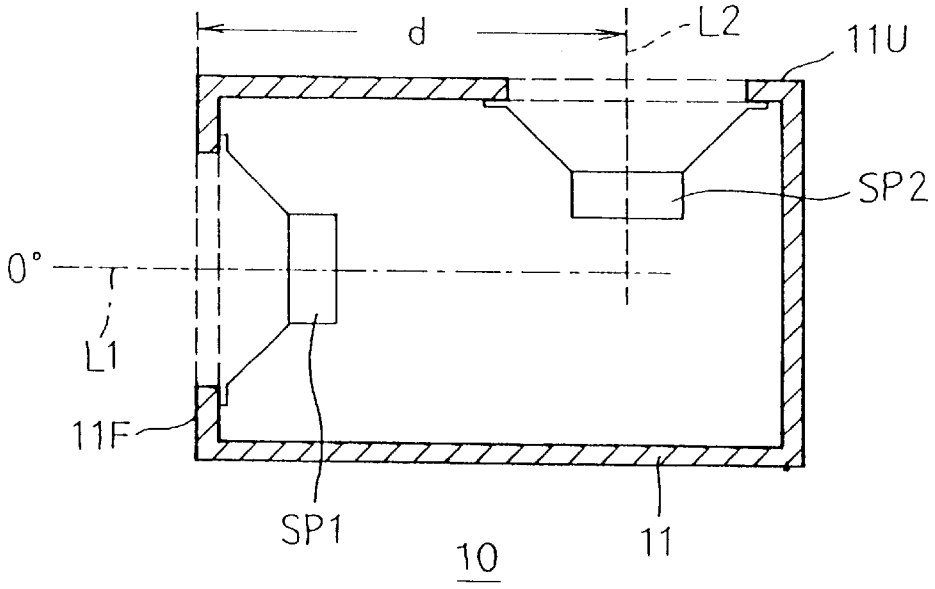
FIG. 2 is a schematic sectional view of the loudspeaker unit.

Preferred embodiments of the present invention will be described hereinafter with reference to the accompanying drawings. FIG. 1 shows a loudspeaker unit 10 in a preferred embodiment according to the present invention.

A first loudspeaker SP1 is attached to a front panel (front wall) 11F of a loudspeaker box 11 having the shape of a rectangular prism as installed. A second loudspeaker SP2 of the same diameter as that of the first loudspeaker SP1 is attached to an upper panel 11U of the loudspeaker box 11. The loudspeaker SP2 is disposed so that its reference axis L2 intersects the reference axis L1 of the loudspeaker SP1.

The loudspeaker SP1 is driven in a positive polarity, and the loudspeaker SP2 is driven in a negative polarity. Driving voltages E1 and −E2 respectively for driving the loudspeakers SP1 and SP2 are optional voltages meeting: E2/E1<1. Since the loudspeakers SP1 and SP2 are the same in diameter, the radiation sound pressure of the loudspeaker SP2 is lower than that of the loudspeaker SP1.

Figure 3:
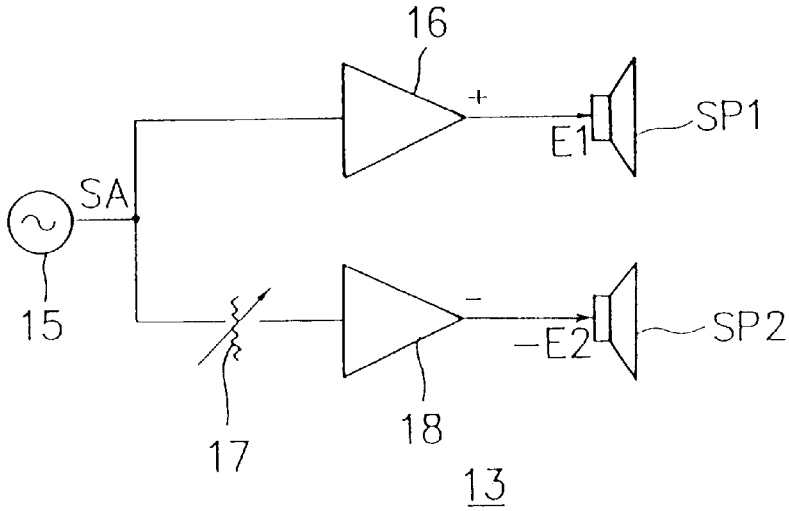
FIG. 3 is a circuit diagram of a driving circuit for driving loudspeakers SP1 and SP2.

FIG. 3 shows a driving circuit 13 for driving the loudspeakers SP1 and SP2. An amplifier 16 amplifies an output speech signal SA provided by a signal source 15 and gives an amplified speech signal to the loudspeaker SP1. Thus, the loudspeaker SP1 is driven by the driving voltage E1 in a positive polarity. An attenuator 17 attenuates the output speech signal SA provided by the signal source 15, and an amplifier 18 amplifies and inverts the output of the attenuator 17 and gives its output to the loudspeaker SP2. Thus, the loudspeaker SP2 is driven by the driving voltage −E2 (E2<E1) in a negative polarity.

A method of driving the loudspeaker SP2 by a driving power lower than that for driving the loudspeaker SP1 provides the loudspeaker SP2 with a voice coil of a resistance higher than that of a voice coil for the loudspeaker SP1. When the loudspeaker SP1 and SP2 are provided with such voice coils, a current which flows through the voice coil of the loudspeaker SP2 is smaller than that which flows through the voice coil of the loudspeaker SP1, and hence driving power for driving the loudspeaker SP2 is lower than that for driving the loudspeaker SP1. This method is advantageous in using one amplifier for the parallel driving of the two loudspeakers.

Suppose that the driving circuit shown in FIG. 1 drives the loudspeakers SP1 and SP2 simultaneously by driving power F1 and driving power −F2, respectively. Then, the vibration velocity V1 of the diaphragm of the loudspeaker SP1 is expressed as follows:

$$V1 = V0\left\{1 + \left(1 + \frac{F2}{F1}\right)\frac{s1}{s0} \cdot \frac{1}{1 + \frac{j\omega}{\omega 0 Q0} + \frac{(j\omega)^2}{\omega 0^2}}\right\} \tag{1}$$

V0 is expressed in Equation (2). Here, s0 is the equivalent stiffness of the diaphragm, m0 is the effective mass of the diaphragm, r0 is equivalent mechanical resistance including electromagnetic damping resistance, s1 is the equivalent stiffness of air in the box, $\omega$0 a minimum resonance angular frequency dependent on m0 and s0, and Q0 is the Q factor of the resonance of the diaphragm.

$$V0 = \frac{F1}{\frac{s0 + 2s1}{(j\omega)^2 m0} + \frac{r0}{j\omega m0} + 1} \tag{2}$$

The vibrating velocity of the diaphragm of the loudspeaker SP2 is expressed as follows:

$$V2 = -V0\left\{\frac{F2}{F1} + \left(1 + \frac{F2}{F1}\right)\frac{s1}{s0} \cdot \frac{1}{1 - \left(\frac{\omega}{\omega 0}\right)^2 + \frac{j\omega}{\omega 0 Q0}}\right\} \tag{3}$$

The second terms in brackets of Equations (1) and (3) express the effect of the mutual influence of the two loudspeakers jointly using a single air chamber and can be handled as follows. The second term in brackets has a second-order LPF (low-pass filter) characteristic and its cutoff frequency f0 is equal to the lowest resonance frequency of the diaphragm of the loudspeaker. Usually, the cutoff frequency f0 can be set at a low frequency not higher than 200 Hz, and a condition: s1/s0<<1 can be very easily satisfied by properly determining the volume of the box.

Therefore, the second term in brackets is very small as compared with the first term in brackets and may be omitted if the loudspeaker unit is intended to be capable of dealing with sounds of frequencies not lower than about 200 Hz.

If the second term in brackets is omitted, V1 and V2 can be expressed by Equations (4) and (5).

$$V1 = V0 \tag{4}$$

$$V2=-V0(F2/F1) \tag{5}$$

Figure 4:
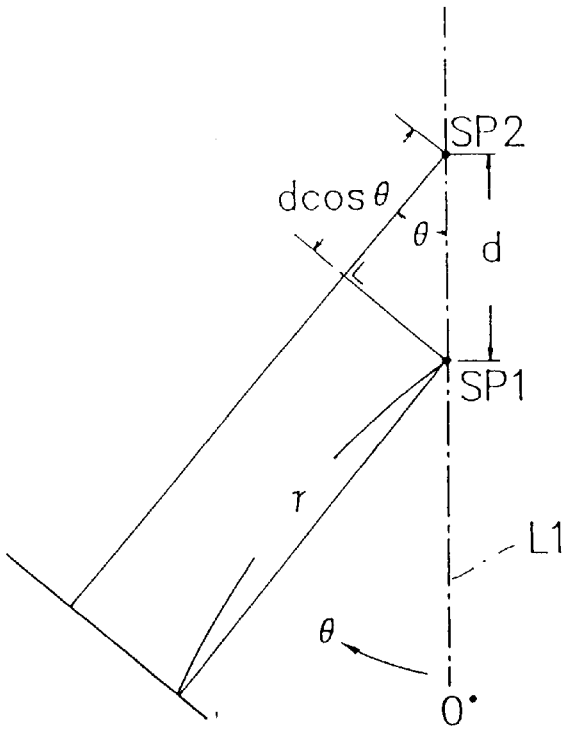
FIG. 4 is a diagram of assistance in explaining the theoretical analysis of the synthesis sound pressure of sound waves radiated by the loudspeakers SP1 and SP2.

An idea illustrated in FIG. 4 is applied to the theoretical examination of the synthesis sound pressure of sound waves radiated by the loudspeaker SP1 and SP2. In FIG. 4, the distance between a plane including the front surface of the loudspeaker SP1 and the reference axis of the loudspeaker SP2 is indicated at d and, in discussing components of sound waves radiated by the loudspeaker SP1 and SP2 with respect to a direction in a horizontal plane, a direction parallel to the reference axis L1 of the loudspeaker SP1 is called a 0°-direction, and the angle θ between a direction and the reference axis L1 is measured clockwise.

Referring to FIG. 4, a sound wave at a receiving position may be regarded as a plane wave if the sound receiving position is at a distance r from the loudspeaker. Since the diaphragm of the loudspeaker has a finite area, the directivity of a sound wave radiated from the surface of the diaphragm is dependent on the dimensions and shape of the box, and the dependence of the directivity of a sound wave on the diameter of the loudspeaker increases as the frequency of the sound wave increases, and the greater the diameter of the loudspeaker, the lower is the frequency of the sound wave at which the sound wave becomes directional.

Suppose that the directivity is represented by directivity factor D(θ). Then, sound pressure P1(θ) of a sound wave radiated by the loudspeaker SP1 is expressed by Equation (6), in which S indicates the effective area of the diaphragm, ρ is the density of air and c is sound velocity.

$$P1(\theta) = \frac{j\omega\rho SV0}{4\pi r} \cdot D(\theta) \cdot e^{-j\frac{\omega r}{c}} \tag{6}$$

Since the loudspeaker SP2 is attached to the upper panel of the loudspeaker box 11, the directivity factor of a sound wave radiated by the loudspeaker SP2 is always D(90°) when θ=0° to 360°. Sound pressure P2(θ) at the sound receiving position is delayed behind the sound pressure P1(θ) by dcos θ, and the loudspeaker SP2 is driven by a negative voltage −E2 which is different from that in the loudspeaker SP1. Therefore, the sound pressure P2(θ) of the sound wave radiated by the loudspeaker SP2 is expressed by Equation (7), in which −V2 is the vibrating velocity of the diaphragm.

$$P2(\theta) = -\frac{j\omega\rho SV0(F2/F1)}{4\pi r} D(90°) \cdot e^{-j\frac{\omega r}{c}} \cdot e^{-j\frac{\omega d}{c}\cos\theta} \tag{7}$$

Since synthesis sound pressure P(θ) is equal to P1(θ)+P2(θ), P(θ) is expressed by Equation (8).

$$P(\theta) = \frac{j\omega\rho SV0(F2/F1)}{4\pi r} e^{-j\frac{\omega r}{c}} \cdot \left(D(\theta) - \frac{F2}{F1} \cdot D(90°) \cdot e^{-j\frac{\omega d}{c}\cos\theta}\right) \tag{8}$$

Suppose that F2/F1=α<1. Then, Equation (9) is obtained by rearranging Equation (8).

$$P(\theta) = \frac{j\omega\rho SV0}{4\pi} e^{-j\frac{\omega r}{c}} \cdot \left(D(\theta) - \alpha D(90°) \cdot e^{-j\frac{\omega d}{c}\cos\theta}\right) \tag{9}$$

The sound pressure P0 of a sound wave radiated by the loudspeaker SP1 at a sound receiving position on reference axis (θ=0°) is expressed by Equation (10), and hence P(θ)/P0 is expressed by Equation (11)

$$P0 = \frac{j\omega\rho SV0}{4\pi r} e^{-j\frac{\omega r}{c}} \tag{10}$$

$$\frac{P(\theta)}{P0} = D(\theta) - \alpha D(90°) \cdot e^{-j\frac{\omega d}{c}\cos\theta} \tag{11}$$

Equation (11) expresses the directivity factor of the synthesis sound pressure at the sound receiving position. Equation (12) is obtained by substituting ω/c by k and introducing trigonometric functions into Equation (11).

$$\frac{P(\theta)}{P0} = D(\theta) - \alpha D(90°)\cos(kd\ \cos\theta) + j\alpha D(90°)\sin(kd\ \cos\theta) \tag{12}$$

Directivity factors for three directions respectively at angles θ=0°, 90° and 180° to the reference axis are expressed by Equations (13), (14) and (15) by using Equation (12).

$$\frac{P(0°)}{P0} = D(0°) - \alpha D(90°)\cos\ kd + j\alpha D(90°)\sin\ kd \tag{13}$$

$$\frac{P(90°)}{P0} = D(90°)\ (1-\alpha) \tag{14}$$

$$\frac{P(180°)}{P0} = D(180°) - \alpha D(90°)\cos\ kd - j\alpha D(90°)\sin\ kd \tag{15}$$

Directivity of a loudspeaker is dependent on the diameter of the loudspeaker, and the shape and dimensions of the box, and the loudspeaker becomes non-directional for sounds of low frequencies. Therefore, for sounds of low frequencies, D(0°)≈D(90°)≈D(180°)≈1. For low-frequency sounds which meet kd<<1, cos kd≈1, sin kd≈kd, and kd may be neglected. Accordingly, P(0°)/P0, P(90°)/P0 and P(180°)/P0 expressed respectively by Equations (13), (14) and (15) are equal to (1−α); that is, for sounds of low frequencies, directivity of a loudspeaker with synthesis sound pressure is (1−α) and the loudspeaker is non-directional.

Directivity of a loudspeaker, which is dependent on the diameter of the loudspeaker, and the shape and dimensions of the box, becomes manifest for sounds of high frequencies, and directivity is sharper for sounds of higher frequencies. The directivity of the loudspeaker unit 10 shown in FIG. 1 is characterized by the possibility of reducing the output sound pressure of the loudspeaker with respect to the 90°-direction regardless of frequency because the directivity factor with respect to the 90°-direction can be obtained by multiplying the directivity factor D(90°) of the loudspeaker by (1−α) (<1) as expressed by Equation (14). The reduction of the output sound pressure does not occur only in the 90°-direction. The sound pressure reduction ratio with respect to direction increases as the angle of direction increases from 0° toward 90°, reaches a maximum of (1−α) at an angle of 90°, and decreases as the angle increases from 90° toward 180°.

The output sound pressure characteristic and directivity of the loudspeaker unit 10 will be more specifically described on the basis of results of experiments.

The front panel of the loudspeaker box 11 to which the loudspeaker SP1 is attached is a square panel of 11 cm by 11 cm, the loudspeaker box 11 is 16 cm in length, the loudspeaker SP1 and SP2 are dynamic loudspeakers of 8 cm in diameter, and d=10 cm.

Results of experiments will be described below.

Figure 5:
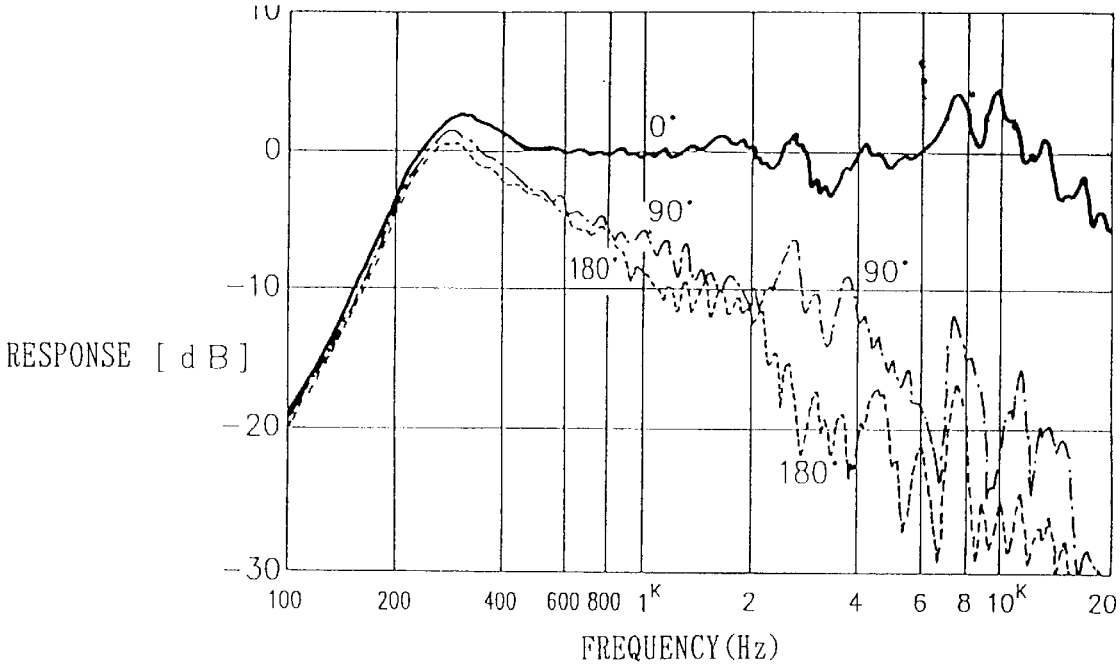
FIG. 5 is a graph showing the frequency characteristic of output sound pressure directivity when only the loudspeaker SP1 is driven.

FIG. 5 is a graph showing the frequency characteristics of output sound pressure directivity for the 0°-direction, the 90°-direction and the 180°-direction measured in an anechoic room when only the loudspeaker SP1 is driven. As is obvious from FIG. 5, the loudspeaker SP1 is substantially non-directional for sounds of frequencies not higher than about 300 Hz. The output sound pressure characteristic with respect to the 90°-direction and the 180°-direction for sounds of frequencies not lower than 300 Hz decreases, on the average, at a rate of about −6 dB/oct as frequency increases, which indicates that the sharpness of directivity increases as frequency increases for sounds of frequencies not lower than 300 Hz.

Figure 6:
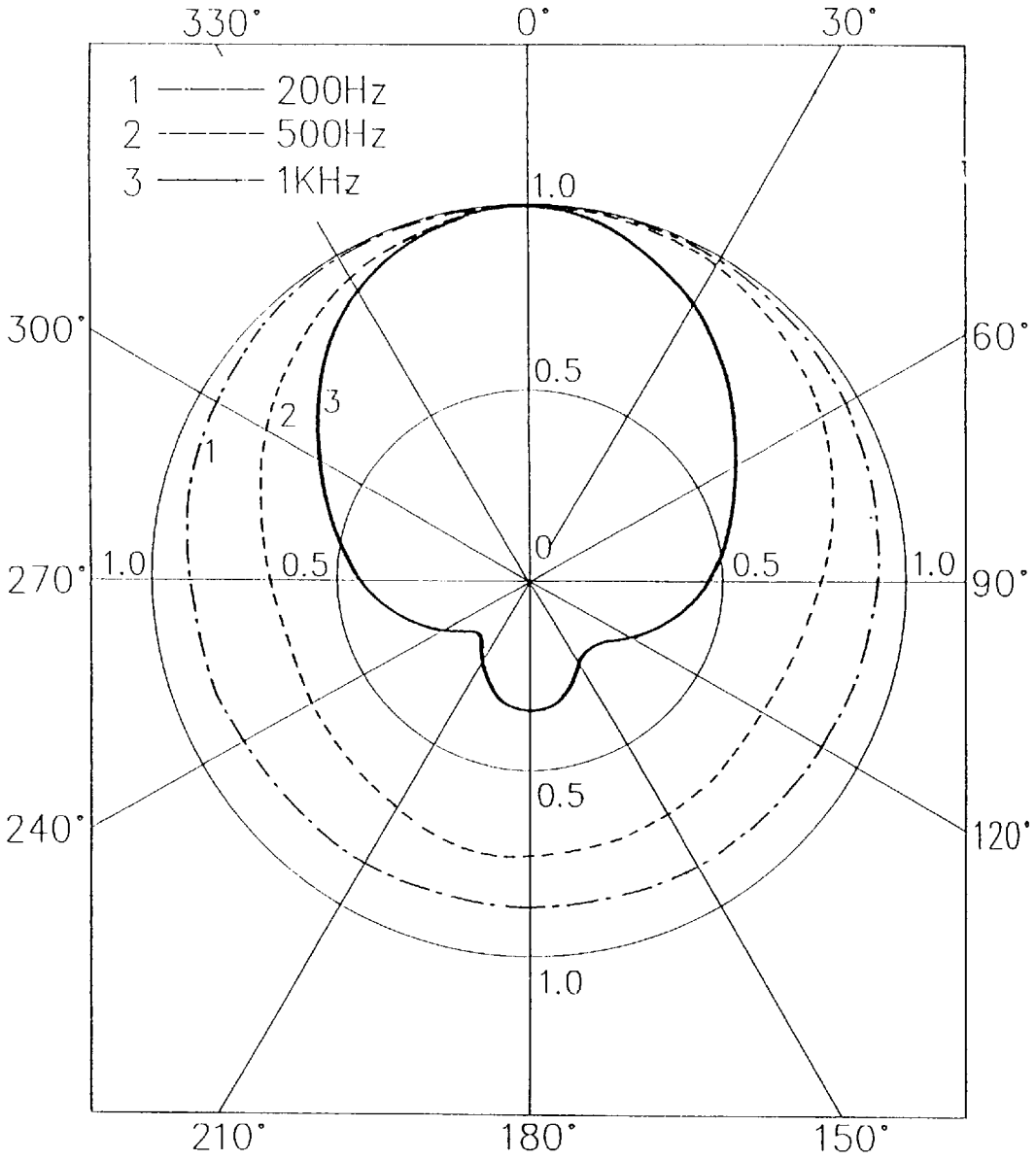
FIG. 6 is a diagram showing directivity patterns for frequencies of 200 Hz, 500 Hz and 1 KHz when only the loudspeaker SP1 is driven.
Figure 7:
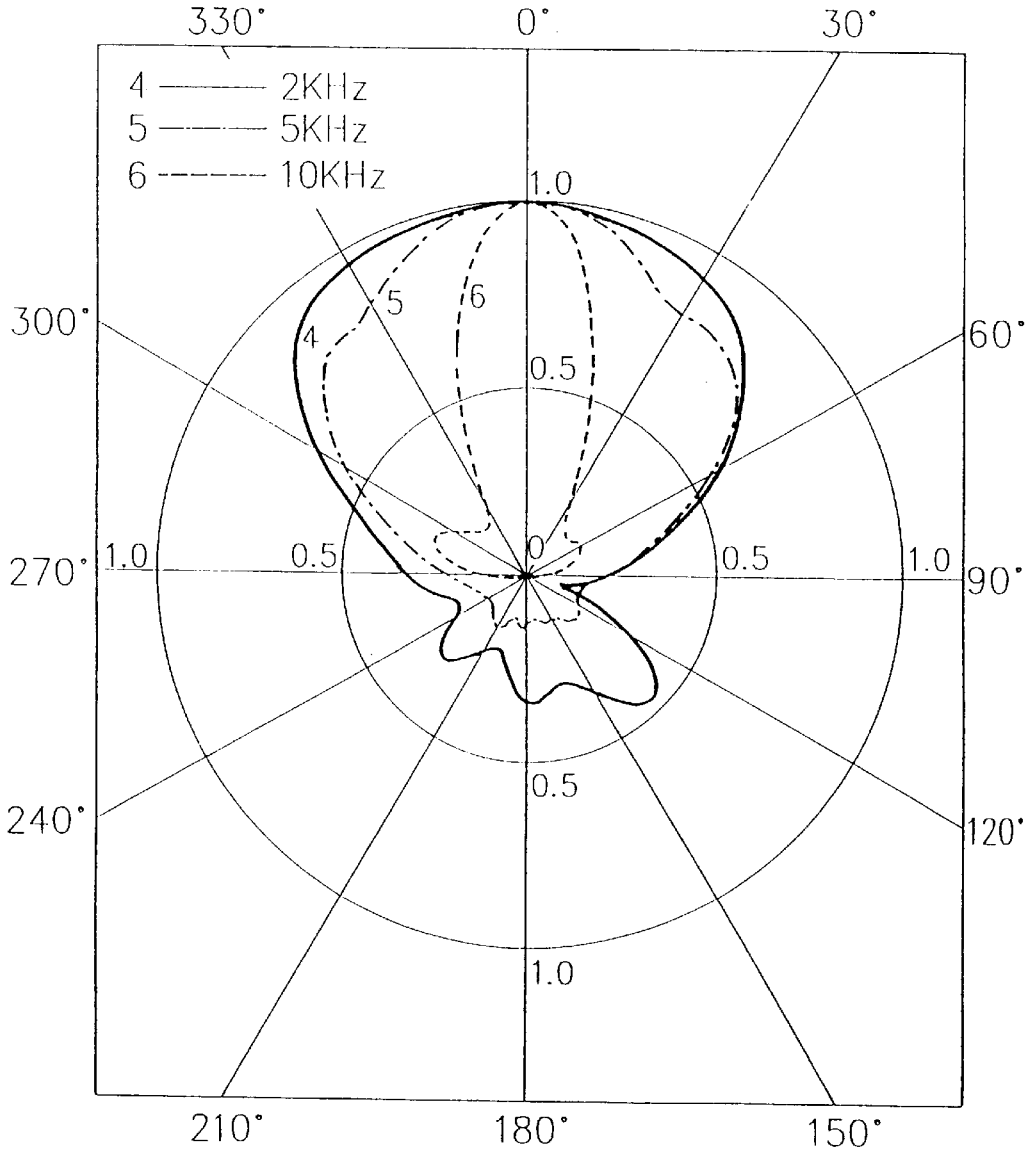
FIG. 7 is a diagram showing directivity patterns for frequencies of 2 KHz, 5 KHz and 10 KHz when only the loudspeaker SP1 is driven.

FIGS. 6 and 7 show measured directivity patterns of the loudspeaker SP1 for frequencies of 200 Hz, 500 Hz, 1 KHz, 2 KHz, 5 KHz and 10 KHz. As is obvious from FIGS. 6 and 7, the directivity is sharper for higher frequencies.

The loudspeaker SP1 is substantially non-directional for sounds of low frequencies lower than 500 Hz, and the reduction of sound pressure with respect to the 90°-direction as compared with the sound pressure with respect to the 0°-direction is excessively small, which is an undesirable directivity in effect on the enlargement of a region for satisfactory stereophonic listening positions.

Results of measurement obtained by driving both the loudspeaker SP1 and SP2 according to the foregoing theory will be described below.

Figure 8:
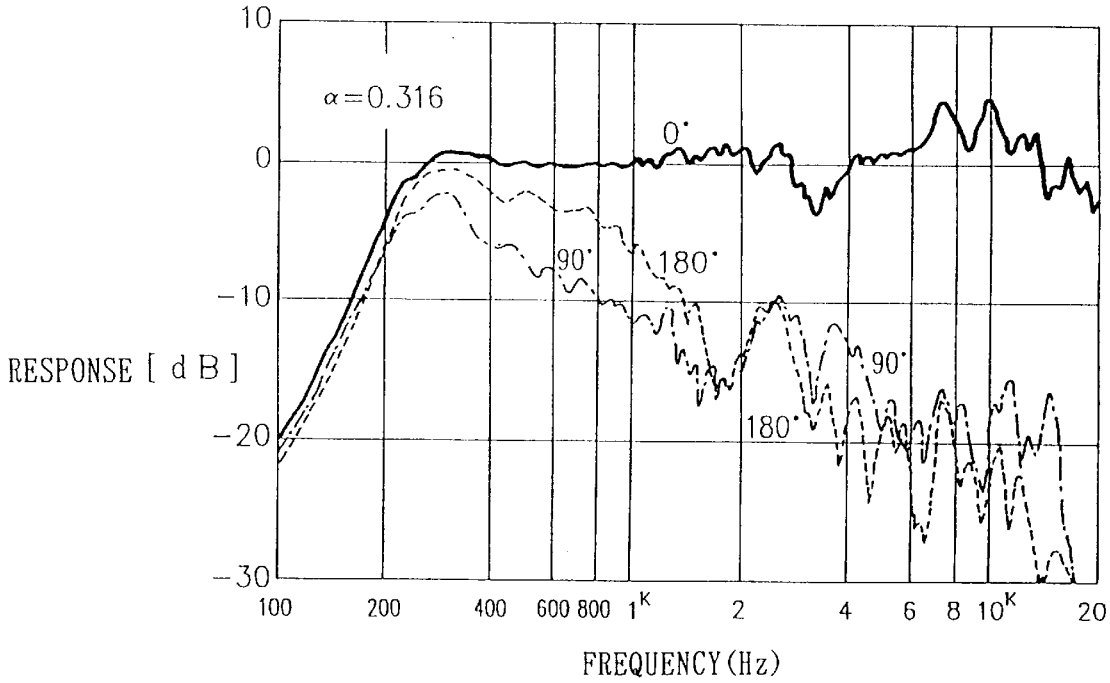
FIG. 8 is a graph showing the frequency characteristic of output sound pressure directivity for $\alpha$=0.361 when both the loudspeakers SP1 and SP2 are driven.
Figure 9:
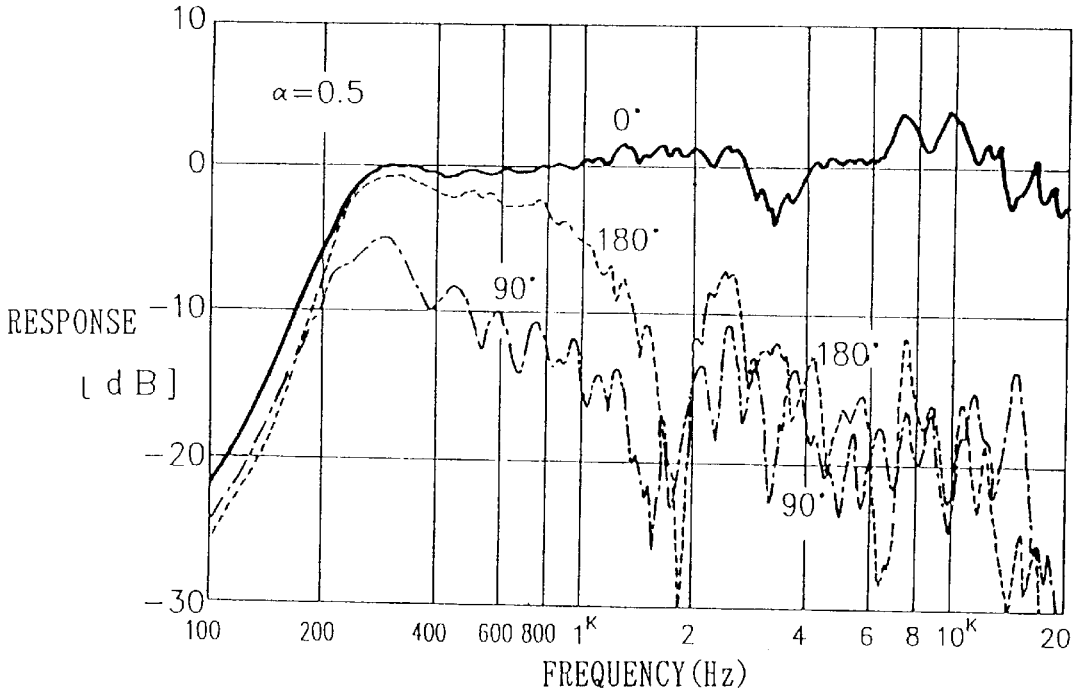
FIG. 9 is a graph showing the frequency characteristic of output sound pressure directivity for $\alpha$=0.5 when both the loudspeakers SP1 and SP2 are driven.
Figure 10:
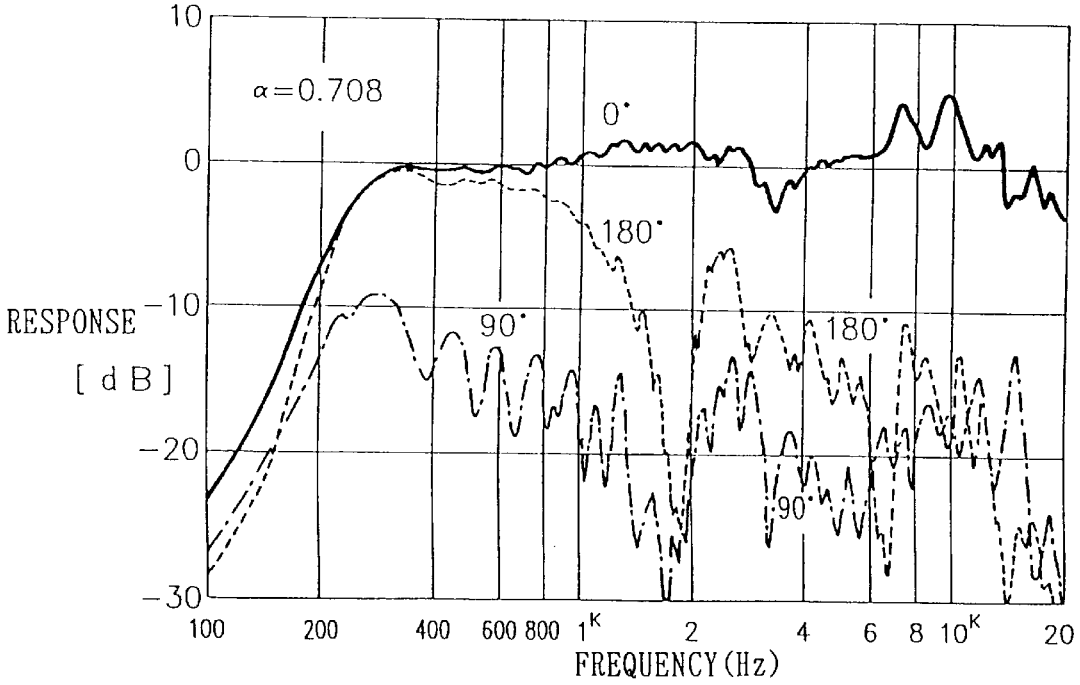
FIG. 10 is a graph showing the frequency characteristic of output sound pressure directivity for $\alpha$=0.708 when both the loudspeakers SP1 and SP2 are driven.

FIGS. 8, 9 and 10 show measured frequency characteristic of output sound pressure directivity with respect to the 0°-direction, the 90°-direction and the 180°-direction for values of $\alpha$ of 0.316 (−10 dB), 0.5 (−6 dB) and 0.708 (−3 dB). As mentioned above in connection with theoretical discussion, the loudspeaker unit is substantially non-directional for frequencies not higher than about 200 Hz. For frequencies higher than 300 Hz, the sound pressure characteristic with respect to the 90°-direction, on the average, is lower the that when only the loudspeaker SP1 is driven by about −3 dB when $\alpha$=0.316, about −6 dB when $\alpha$=0.5, and about −10 dB when $\alpha$=0.708.

The sound pressure characteristic with respect to the 180°-direction has peaks and dips and is higher on the average than that when only the loudspeaker SP1 is driven. However, since sound waves propagating in the 180°-direction are those propagating behind the loudspeaker unit 10 and have no direct effect on the enlargement of the region for satisfactory stereophonic listening position.

The sound pressure characteristic with respect to the 0°-direction, as compared with that when only the loudspeaker SP1 is driven, is scarcely dependent on frequency and the lower limit of the reproducing band is narrowed slightly.

The sound pressure with respect to the 0°-direction is slightly higher than that with respect to the 90°-direction, and the sound pressure with respect to the 180°-direction is slightly lower than that with respect to the 90°-direction for frequencies not higher than 200 Hz. Such a tendency grows as the value of $\alpha$ approaches 1.

This phenomenon is dependent on the distance between the loudspeaker and sound receiving position and can be explained on the basis of the following reasons.

It is mentioned in the foregoing theoretical discussion that the loudspeaker becomes non-directional for sounds of lower frequencies, provided that the distance d between a plane including the front end of the loudspeaker SP1 and the reference axis of the loudspeaker SP2 is negligibly small as compared with the distance r between the loudspeaker SP1 and the sound receiving position. Actually, the distance d, however, is 10 cm while the distance r is 100 cm. Therefore, the distance between the loudspeaker SP2 and the sound receiving position in the 0°-direction is 110 cm and is 90 cm in the 180°-direction.

Therefore, the distance between the loudspeaker SP1 and the sound receiving position and the distance between the loudspeaker SP2 and the sound receiving position are 100 cm and 110 cm in the 0°-direction, respectively, and 100 cm and 90 cm in the 180°-direction, respectively. The difference in sound pressure due to the difference of 10% in distance brings about the foregoing phenomenon. The difference of only 10% in distance causes such a phenomenon because the synthesis sound pressure at the sound receiving position is not the sum of the vectors of the sound waves radiated by the loudspeakers SP1 and SP2 but the same is the difference between the vectors, which is entirely the same as the proximity effect specific to a bidirectional or unidirectional microphone. Such proximity effect is more significant when the sound receiving position is nearer to a sound source.

The frequency characteristic of output sound pressure in the sound pressure with respect to the 0°-direction, the 90°-direction and the 180°-direction has been described. Measured directivity patterns for several frequencies will be described below.

Figure 11:
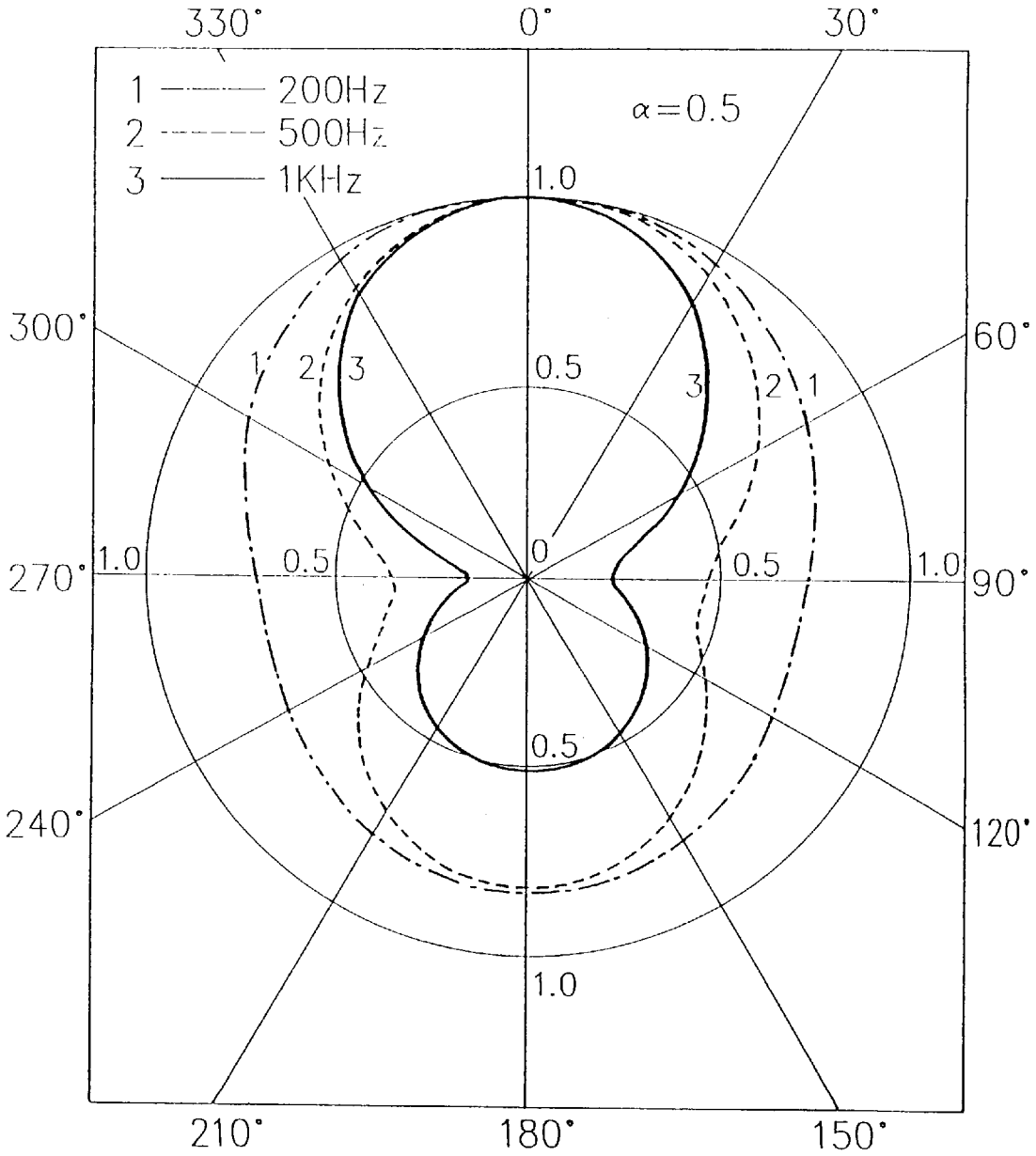
FIG. 11 is a diagram showing directivity patterns for frequencies of 200 Hz, 500 Hz and 1 KHz when both the loudspeakers SP1 and SP2 are driven.
Figure 12:
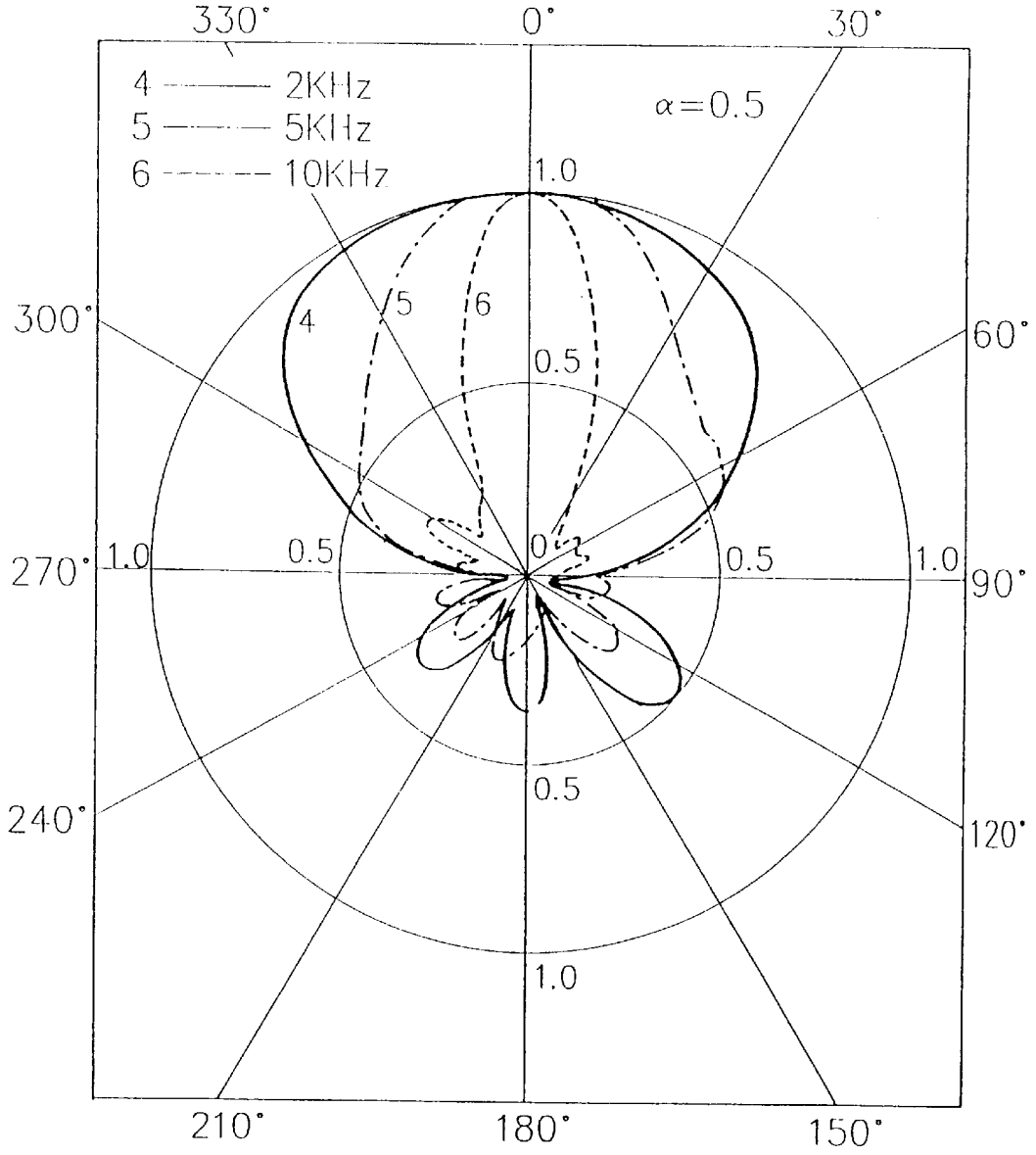
FIG. 12 is a diagram showing directivity patterns for frequencies of 2 KHz, 5 KHz and 10 KHz when both the loudspeakers SP1 and SP2 are driven.
Figure 15:
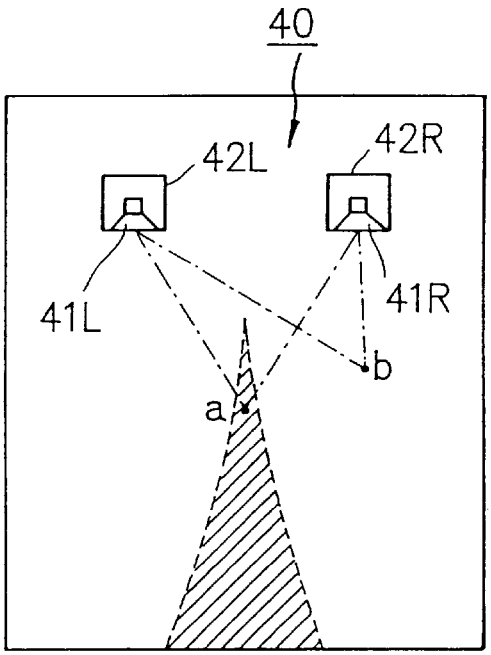
FIG. 15 (PRIOR ART)
FIG. 15 is a diagrammatic view of a two-channel stereophonic loudspeaker unit.
Figure 16:
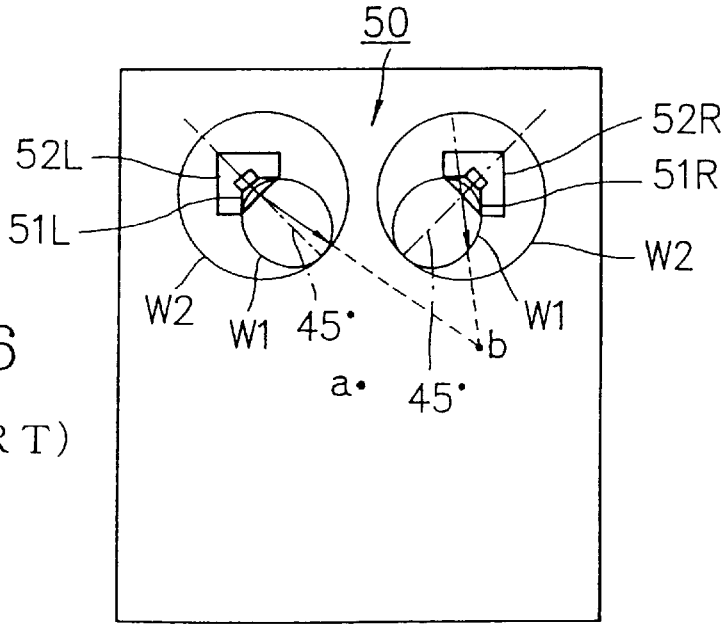
FIG. 16 (PRIOR ART)
FIG. 16 is a diagrammatic view of another two-channel stereophonic loudspeaker unit.
Figure 17:
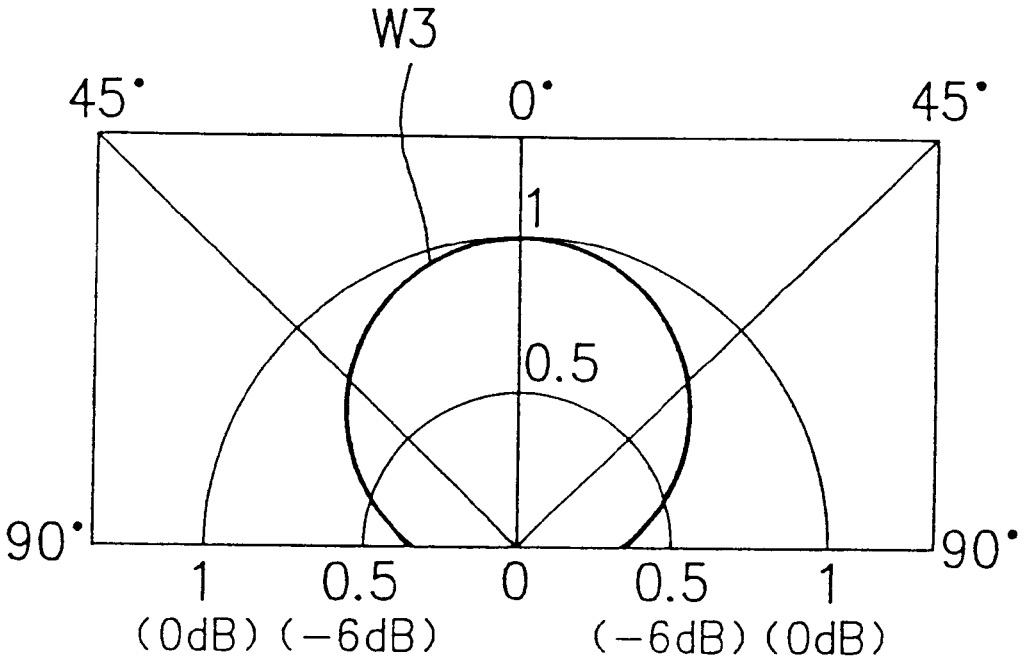
FIG. 17 (PRIOR ART)
FIG. 17 is a diagram of assistance in explaining a directivity effective in enlarging a region for satisfactory stereophonic listening positions.

FIGS. 11 and 12 show directivity patterns corresponding to those shown in FIGS. 6 and 7 when only the loudspeaker SP1 is driven. In FIGS. 11 and 12, $\alpha$=0.5.

The directivity factor of the directivity pattern for frequencies not lower than 2 KHz shown in FIG. 12 with respect to the 90°-direction is smaller than that of the directivity pattern shown in FIG. 7. However, the general directivity pattern shown in FIG. 12 and that shown in FIG. 7 are substantially the same.

The directivity is considerably sharp for frequencies not lower than 2 KHz even if only the loudspeaker SP1 is driven. Therefore, a directivity effective in enlarging the region for stereophonic listening positions can be realized by driving only the loudspeaker SP1.

The directivity factor of the directivity pattern with respect to the 90°-direction for frequencies not higher than 1 KHz shown in FIG. 11 is half that of the directivity pattern shown in FIG. 6, and hence the directivity pattern has a constricted part. Therefore, the loudspeaker unit 10 shown in FIG. 1 has a directivity suitable for enlarging a region for stereophonic listening positions.

Although the loudspeaker SP2 of the loudspeaker unit 10 in the foregoing embodiment is attached to the upper panel 11U of the loudspeaker box 11 as installed, the loudspeaker SP2 may be attached to the lower panel or the back panel of the loudspeaker box 11. Although the loudspeaker SP1 and SP2 employed in the foregoing embodiment have the same diameter, the loudspeaker unit 10 may be provided with loudspeakers respectively having different diameters. Even if the loudspeakers SP1 and SP2 are those respectively having different diameters, the sound pressure of sounds radiated by the loudspeaker SP2 must be lower than that of sounds radiated by the loudspeaker SP1.

In the loudspeaker unit according to the present invention, the first loudspeaker driven in a positive polarity is attached to the front panel of the loudspeaker box, the second loudspeaker driven in a negative polarity is attached to, for example, the upper panel of the loudspeaker box, the sound pressure of sounds radiated by the second loudspeaker is lower than that of sounds radiated by the first loudspeaker, and the directivity factor of the synthesis sound pressure of the first and the second loudspeaker at a sound receiving position with respect to the 90°-direction is equal to the product of the directivity factor of the loudspeaker and a value smaller than one. Accordingly, the directivity makes the sound pressure with respect to the 90°-direction lower than that with respect to the 0°-direction (forward direction) for frequencies not higher than 1 KHz by 6 dB or above, so that the directivity is suitable for enlarging the region for satisfactory stereophonic listening positions.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A loudspeaker unit comprising:

a loudspeaker box;

a first loudspeaker attached to a front panel of the loudspeaker box as installed; and a second loudspeaker attached to an upper panel, a lower panel or a back panel of the loudspeaker box as installed;

wherein the first loudspeaker is driven by an input signal in a positive polarity and the second loudspeaker is driven by said input signal in a negative polarity; and wherein sound pressure of sounds radiated by the second loudspeaker along an axis of the second loudspeaker is lower than that of sounds radiated by the first loudspeaker along an axis of the first loudspeaker.

2. A loudspeaker unit according to claim 1, wherein the respective diameters of the first and the second loudspeakers are equal to each other, and a driving voltage for driving the second loudspeaker is lower than that for driving the first loudspeaker.

3. A loudspeaker unit having an input terminal for receiving an audio signal and comprising:

a loudspeaker box, a first loudspeaker attached to a front panel of the loudspeaker box, a second loudspeaker attached to an upper panel, a lower panel or a back panel of the loudspeaker box, a first amplifier connected between the input terminal of the loudspeaker unit and the first loudspeaker for supplying a drive signal for the first loudspeaker derived from the audio signal, and a second amplifier connected between the input terminal and the second loudspeaker for supplying a drive signal for the second loudspeaker derived from the audio signal, and wherein the second amplifier is an inverting amplifier and the first amplifier is a non-inverting amplifier, whereby the drive signal for the second loudspeaker is of opposite polarity to the drive signal of the first loudspeaker.

4. A loudspeaker unit according to claim 3 comprising a means for attenuating the drive signal for the second loudspeaker relative to the drive signal for the first loudspeaker.

5. A loudspeaker unit according to claim 3, wherein the first and second loudspeakers are of substantially equal diameter.

6. A method of operating loudspeaker unit which includes a loudspeaker box, a first loudspeaker attached to a front panel of the loudspeaker box as installed and a second loudspeaker attached to an upper panel, a lower panel or a back panel of the loudspeaker box as installed, said method comprising:

driving the first loudspeaker by an input signal in a positive polarity and driving the second loudspeaker by said input signal in a negative polarity, and wherein sound pressure of sounds radiated by the second loudspeaker along an axis of the second loudspeaker is lower than that of sounds radiated by the first loudspeaker along an axis of the first loudspeaker.

* * * * *